United States Patent [19]

Suzuki et al.

[11] Patent Number: 4,514,745

[45] Date of Patent: Apr. 30, 1985

[54] HEAT-SENSITIVE RECORDING MATERIAL

[75] Inventors: Toshitake Suzuki, Hyogo; Naoto Arai, Osaka; Shoji Aoyagi, Hyogo; Toranosuke Saito, Osaka; Masakatsu Kitani, Hyogo; Takashi Ishibashi, Osaka, all of Japan

[73] Assignees: Kanzaki Paper Manufacturing Co. Ltd.; Sanko Kaihatsu Kagaku Kenkyusho Corporation, both of Japan

[21] Appl. No.: 635,580

[22] Filed: Jul. 30, 1984

[30] Foreign Application Priority Data

Aug. 23, 1983 [JP] Japan ..... 58-154379

[51] Int. Cl.[3] ..... B41M 5/18

[52] U.S. Cl. ..... 346/216; 346/225; 427/150; 427/151

[58] Field of Search ..... 346/216, 217, 225; 427/150, 151

[56] References Cited

U.S. PATENT DOCUMENTS 3,539,375 11/1970 Baum ..... 346/217
3,664,858 5/1972 Huffman ..... 346/216

FOREIGN PATENT DOCUMENTS 2372 1/1982 Japan ..... 346/216
203591 12/1982 Japan ..... 346/216
224786 12/1983 Japan ..... 346/216

*Primary Examiner*—Bruce H. Hess
*Attorney, Agent, or Firm*—Murray, Whisenhunt and Ferguson

[57] ABSTRACT

In a heat-sensitive recording material incorporating a colorless or pale-colored basic dye and a color acceptor which is reactive with the dye to form a color when contacted therewith, the recording material characterized in that the color acceptor comprises at least one compound represented by the formula

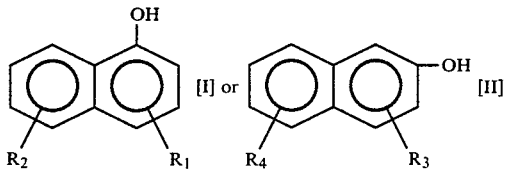

wherein $R_1$, $R_2$, $R_3$ and $R_4$ are each a hydrogen atom, alkyl having 1 to 8 carbon atoms, aryl or aralkyl, provided that $R_1$ and $R_2$, as well as $R_3$ and $R_4$, are not hydrogen at the same time.

3 Claims, No Drawings

HEAT-SENSITIVE RECORDING MATERIAL

This invention relates to heat-sensitive recording materials, and more particularly to heat-sensitive recording materials suited to high-speed recording and adapted to form colorfast record images.

Heat-sensitive recording materials are well known which are adapted to produce record images by thermally contacting a colorless or pale-colored basic dye with an organic or inorganic color acceptor for a color forming reaction.

With remarkable progress in heat-sensitive recording systems in recent years, heat-sensitive facsimile systems, heat-sensitive printers, etc. equipped with a thermal head are made operable at a high speed. For example, heat-sensitive facsimile systems produce a copy of A4 size within 20 seconds, and heat-sensitive printers achieve a recording speed of at least 120 characters/sec. For use with such heat-speed hardware, heat-sensitive recording materials must meet the requirements of having a high recording sensitivity, being free of unnecessary recording at low temperatures of 60° to 70° C., being free from extraneous deposits (piling) on the thermal head that would produce a discontinuous record, giving records which are retainable over a prolonged period of time, etc.

Conventional heat-sensitive recording materials of high sensitivity include those incorporating stearic acid amide or like sensitizer in combination with a basic dye and bisphenol A or like phenolic compound, and those incorporating a basic dye and benzyl p-hydroxybenzoate or like high-sensitivity color acceptor in combination therewith.

However, the former recording materials have the drawback that with an improvement in recording sensitivity, unnecessary records are more likely to appear at low temperatures of 60° to 70° C., while the latter recording materials have the drawback that the record density decreases with time, such that the color fades markedly especially at the portion bearing fingerprints.

An object of the present invention is to provide a heat-sensitive recording material suited to high-speed recording and having balanced properties.

Stated specifically, the invention provides a heat-sensitive recording material incorporating a colorless or pale-colored basic dye and a color acceptor which is reactive with the basic dye to form a color when contacted therewith, the recording material being characterized in that the color acceptor comprises at least one compound represented by the formula

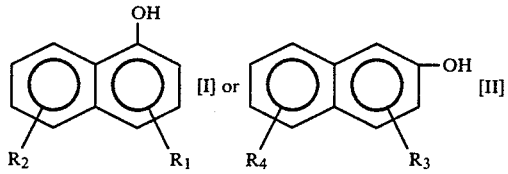

wherein $R_1$, $R_2$, $R_3$ and $R_4$ are each a hydrogen atom, alkyl having 1 to 8 carbon atoms, aryl or aralkyl, provided that $R_1$ and $R_2$, as well as $R_3$ and $R_4$, are not hydrogen at the same time.

In the above, $R_1$ to $R_4$ are preferably each a hydrogen atom, alkyl having 1 to 5 carbon atoms, phenyl, benzyl or phenethyl.

To obtain heat-sensitive recording materials suited to high-speed recording hardware, we have conducted extensive research and found that heat-sensitive recording materials incorporating the compound of the formula (I) or (II) are well-suited to high-speed recording and produce record images having outstanding retainability.

Although the reason why the compound of the formula (I) or (II) has such high amenability to high-speed recording still remains to be definitely clarified, this feature of the compound appears attributable to the fact that it distinctly melts at about 100° C. and effectively dissolves basic dyes therein to smoothly undergo a color forming reaction. Accordingly use of the compound eliminates the need for sensitizers, reduces the amount of melt for recording and serves to mitigate piling.

Further although the reason why the compound gives outstanding retainability to the recorded images is totally unknown, the compound is effective for inhibiting the reduction of color density at fingerprint bearing portions. Thus, the use of the compound overcomes all the drawbacks experienced in the prior art.

Although heat-sensitive record materials are known which have incorporated therein α-naphthol or β-naphthol (U.S. Pat. No. 3,539,375), or compound of the formula (III) (Unexamined Japanese Patent Publication No. 203591/1982) and which are seemingly similar to the present material, these compounds differ from the present compounds of the formula (I) or (II) in structure.

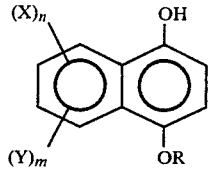

(III)

wherein R is an alkyl having 1 to 10 carbon atoms, X and Y are each an alkyl, hydroxyl, halogen atom or alkoxyl, n and m are each 0, 1, 2 or 3, and $(n+m)<4$.

Examples of the compounds represented by the formula [I] and [II] are, for example,

| | |
|---|---|
| 1-Benzyl-naphthol-(2) | mp 111° C. |
| 4-Benzyl-naphthol-(1) | mp 125° C. |
| 2-Benzyl-naphthol-(1) | mp 74° C. |
| 4-Phenyl-naphthol-(1) | mp 140° C. |
| 5-Phenyl-naphthol-(2) | mp 148° C. |
| 7-Phenyl-naphthol-(2) | mp 156° C. |
| 6-Benzyl-naphthol-(2) | mp 100° C. |
| 4-Methyl-3-phenyl-naphthol-(1) | mp 127° C. |
| 2-Phenethyl-naphthol-(1) | mp 78° C. |
| 1,6-Di-tert-butyl-naphthol-(2) | mp 139° C. |
| 6-[1-Methyl-1-phenyl-ethyl]-naphthol-(2) | mp 99° C. |

These compounds can be used singly or in mixture of at least two of them.

Various known colorless or pale-colored basic dyes are used in the recording layer of the present heat-sensitive recording material. Examples of useful dyes are:

Triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphtopyran, 3-methyl-naphtho-(6'-methoxybenzo)spiropyran, 3-propyl-spiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)-fluoran, 3-butylamino-7-(o-chlorophenylamino)fluoran, 3-pyrrolidino-6-methyl-7-p-butylphenylaminofluoran, 3-(N-methyl-N-n-amylamino)-6-methyl-7-phenylaminofluoran, 3-(N-ethyl-N-n-amylamino)-6-methyl-7-phenylaminofluoran, 3-(N-methyl-N-n-hexylamino)-6-methyl-7-phenylaminofluoran, 3-(N-ethyl-N-n-hexylamino)-6-methyl-7-phenylaminofluoran, 3-(N-ethyl-N-$\beta$-ethylhexylamino)-6-methyl-7-phenylaminofluoran, etc. The basic dyes of the invention are not limited thereto. Further, these dyes can be used singly or in mixture of at least two of them.

With the heat-sensitive recording materials of the invention, the proportions of the color acceptor having the above specific structure and the basic dye are not particularly limited. The former is used in an amount of preferably 100 to 700 parts by weight, more preferably 150 to 400 parts by weight per 100 parts by weight of the latter.

For preparing a coating composition comprising the foregoing components, the basic dye and the color acceptor are dispersed, together or individually, into water serving as a dispersion medium, using stirring and pulverizing means such as a ball mill, attritor or sand mill. Usually the coating composition has incorporated therein a binder in an amount of 10 to 40% by weight, preferably 15 to 30% by weight, based on the total solids content of the composition. Examples of useful binders are starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, styrene-butadiene copolymer emulsion, etc. Various other auxiliary agents can be further added to the coating composition. Examples of useful agents are dispersants such as sodium dioctylsulfosuccinate, sodium dodecylbenzenesulfonate, sodium salt of lauryl alcohol sulfuric acid ester, fatty acid metal salts, etc., ultraviolet absorbers such as triazole compounds, defoaming agents, fluorescent dyes, coloring dyes, etc.

Further, to the composition may be added, in order to prevent sticking upon contact of the heat-sensitive recording paper with a recording device or thermal head, a dispersion or emulsion of stearic acid, polyethylene, carnauba wax, paraffin wax, zinc stearate, calcium stearate, ester wax or the like.

Further, to the composition may be added in an amount which does not cause adverse effect, aliphatic fatty acid amide such as stearic acid amide, stearic acid methylenebisamide, oleic acid amide, palmitic acid amide, coconut fatty acid amide, etc; hindered phenols such as 2,2'-methylene-bis(4-methyl-6-tert-butylphenol), 1,1,3-tris(2-methyl-4-hydroxy-5-tert-butylphenyl)butane, etc; and various known heat-fusible substances.

In addition, to the composition may be added in order to prevent the adhesion of tailings to the thermal head, inorganic pigment such as kaolin, clay, talc, calcium carbonate, calcined clay, titanium oxide, kieselguhr, finely divided anhydrous silica, activated clay, etc.

Further, it is possible to add a usual color acceptor such as phenolic ones to the composition in an amount which does not entail adverse effect.

As a substrate (support) to be coated, may be used a paper, plastic film, synthetic fiber paper or the like, but a paper is most preferably used from a viewpoint of cost, coating applicability, etc. The amount of coating composition forming the recording layer to be applied to the support, which is not limited particularly, is usually 2 to 12 g/m$^2$, preferably 3 to 10 g/m$^2$, based on dry weight. Further, it is possible to form an over-coat layer on the recording layer to protect the layer. Various other known techniques in the field of heat-sensitive recording material can be applied. For example, it is possible to form a protect layer on the rear face of the support, to form a primary coating layer on the support.

The heat-sensitive recording materials thus obtained suited to high-speed recording, give colorfast record images and are free from extraneous deposits on the thermal head (piling).

The invention will be described below in more detail with reference to Examples and Comparison Examples by no means limited to, in which parts and percentages are all by weight, unless otherwise specified.

EXAMPLE 1

(1) Composition (A)

3-(N-cyclohexyl-N-methylamino)-6-methyl-7-phenylaminofluoran (10 parts), 20 parts of 5% aqueous solution of methyl cellulose and 10 parts of water were pulverized by a sand mill to prepare Composition (A) having an average particle size of 3 $\mu$m.

(2) Composition (B)

1-Benzyl-naphthol-(2) (30 parts), 70 parts of 5% aqueous solution of methyl cellulose and 20 parts of water were pulverized by a sand mill to obtain Composition (B) having an average particle size of 3 μm.

(3) Preparation of a recording layer

A 40-part quantity of Composition (A), 120 parts of Composition (B), 30 parts of finely divided anhydrous silica (oil absorption: 180 ml/100 g), 100 parts of 20% aqueous solution of oxidized starch and 70 parts of water were mixed with stirring to prepare a coating composition. The coating composition was applied to a paper substrate weighting 50 g/m$^2$ in an amount of 7 g/m$^2$ by dry weight to prepare a heat-sensitive recording paper.

EXAMPLE 2

A heat-sensitive recording paper was prepared in the same manner as in Example 1 except that 3-(N-ethyl-N-isoamylamino)-6-methyl-7-phenylaminofluoran was used in place of 3-(N-cyclohexyl-N-methylamino)-6-methyl-7-phenylaminofluoran in the preparation of Composition (A).

EXAMPLE 3

A heat-sensitive recording paper was prepared in the same manner as in Example 1 except that 4-benzyl-naphthol-(1) was used in place of 1-benzyl-naphthol-(2) in the preparation of Composition (B).

EXAMPLE 4

A heat-sensitive recording paper was prepared in the same manner as in Example 2 except that 4-benzyl-naphthol-(1) was used in place of 1-benzylnaphthol-(2) in the preparation of Composition (B).

EXAMPLE 5

A heat-sensitive recording paper was prepared in the same manner as in Example 1 except that 6-benzyl-naphthol-(2) was used in place of 1-benzyl-naphthol-(2) in the preparation of Composition (B).

EXAMPLE 6

A heat-sensitive recording paper was prepared in the same manner as in Example 2 except that 6-benzyl-naphthol-(2) was used in place of 1-benzyl-naphthol-(2) in the preparation of Composition (B).

EXAMPLE 7

A heat-sensitive recording paper was prepared in the same manner as in Example 1 except that 4-methyl-3-phenyl-naphthol-(1) was used in place of 1-benzyl-naphthol-(2) in the preparation of Composition (B).

EXAMPLE 8

A heat-sensitive recording paper was prepared in the same manner as in Example 2 except that 4-methyl-3-phenyl-naphthol-(1) was used in place of 1-benzyl-naphthol-(2) in the preparation of Composition (B).

COMPARISON EXAMPLE 1

A heat-sensitive recording paper was prepared in the same manner as in Example 1 except that 2,2-bis(4'-oxyphenyl)propane [bisphenol A] was used in place of 1-benzyl-naphthol-(2) in the preparation of Composition (B).

COMPARISON EXAMPLE 2

A heat-sensitive recording paper was prepared in the same manner as in Example 1 except that benzyl p-hydroxybenzoate was used in place of 1-benzyl-naphthol-(2) in the preparation of Composition (B).

COMPARISON EXAMPLE 3

A heat-sensitive recording paper was prepared in the same manner as in Example 2 except that 2,2-bis(4'-oxyphenyl)propane [bisphenol A] was used in place of 1-benzyl-naphthol-(2) in the preparation of Compositon (B).

COMPARISON EXAMPLE 4

A heat-sensitive recording paper was prepared in the same manner as in Example 2 except that benzyl p-hydroxybenzoate was used in place of 1-benzyl-naphthol-(2) in the preparation of Composition (B).

The twelve kinds of heat-sensitive recording papers thus prepared were fed to a heat-sensitive facsimile system (Hitachi HIFAX-700 Model, a product of Hitachi Ltd.) for recording and checked for color density ($D_1$) by Macbeth densitometer (Model RD-100R, with an amber filter, a product of Macbeth Corp.). Table 1 shows the results.

The papers with the record images were further allowed to stand at 40° C. and 90% RH for 24 hours and then similarly checked for color density ($D_2$) to determine percent color density retention [$(D_2/D_1)\times 100$]. Table 1 shows the results.

To test the papers for colorfastness against fingerprinting, fingertips were impressed on image areas. Twenty-four hours later, the record images were checked with the unaided eye for the degree of fading of the color.

TABLE 1

| | Color Density ($D_1$) | Color Density after Humidity Test ($D_2$) | Retention (%) | Fingerprint Test |
|---|---|---|---|---|
| Ex. 1 | 1.25 | 1.19 | 95 | |
| " 2 | 1.30 | 1.13 | 87 | |
| " 3 | 1.15 | 1.10 | 95 | |
| " 4 | 1.20 | 1.08 | 90 | |
| " 5 | 1.20 | 1.10 | 92 | |
| " 6 | 1.25 | 1.06 | 85 | |
| " 7 | 1.11 | 1.05 | 95 | |
| " 8 | 1.15 | 1.04 | 90 | |
| Com. Ex. 1 | 0.53 | 0.52 | 98 | |
| " 2 | 1.26 | 0.95 | 75 | X |
| " 3 | 0.60 | 0.57 | 95 | |
| " 4 | 1.29 | 0.84 | 65 | X |

(Note)
Criteria in fingerprint test
record image hardly faded
record image slightly faded
X record image markedly faded

We claim:

1. In a heat-sensitive recording material incorporating a colorless or pale-colored basic dye and a color acceptor which is reactive with the dye to form a color when contacted therewith, the recording material characterized in that the color acceptor comprises at least one compound represented by the formula

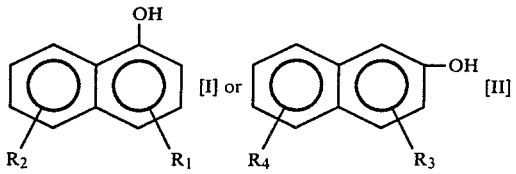

wherein $R_1$, $R_2$, $R_3$ and $R_4$ are each a hydrogen atom, alkyl having 1 to 8 carbon atoms, aryl or aralkyl, provided that $R_1$ and $R_2$, as well as $R_3$ and $R_4$, are not hydrogen at the same time.

2. A heat-sensitive recording material as defined in claim 1 wherein $R_1$ to $R_4$ are each a hydrogen atom, alkyl having 1 to 5 carbon atoms, phenyl, benzyl or phenethyl.

3. A heat-sensitive recording material as defined in claim 1 wherein the color acceptor represented by the formula (I) or (II) is used in an amount of 100 to 700 parts by weight per 100 parts by weight of the basic dye.

* * * * *